United States Patent [19]

Fiegl et al.

[11] 4,056,065

[45] Nov. 1, 1977

[54] REJECTION FEATURE FOR CENTER PLATE

[75] Inventors: David Elmer Fiegl, Williamsville; Vaughn Terrey Hawthorne, East Amherst; Albert Edward Martin, Lancaster, all of N.Y.

[73] Assignee: Dresser Industries, Inc., Dallas, Tex.

[21] Appl. No.: 733,971

[22] Filed: Oct. 19, 1976

[51] Int. Cl.[2] ..... B61C 9/48

[52] U.S. Cl. ..... 105/199 C; 105/228; 308/137

[58] Field of Search ..... 308/137, 138, 140; 105/226, 228, 199 C, 199 CB; 213/50, 51

[56] References Cited

U.S. PATENT DOCUMENTS

| | | | |
|---|---|---|---|
| 3,797,674 | 3/1974 | Reynolds | 105/199 C X |
| 3,985,235 | 10/1976 | Buzza | 105/199 C X |

*Primary Examiner*—Albert J. Makay

*Attorney, Agent, or Firm*—Raymond T. Majesko; John N. Hazelwood

[57] ABSTRACT

A body bolster center filler-center plate assembly having a center plate containing a lower cap and upwardly extending sidewalls which extend into and are secured within a bottom-open pocket formed by center sill sidewalls and shear plates, the shear plates and center plate walls having a stop lug and a complementary notch, respectively, for polarizing the center plate within the pocket.

9 Claims, 8 Drawing Figures

REJECTION FEATURE FOR CENTER PLATE

It is conventional that the entire freight car weight is carried on two circular center plates secured to two body bolsters and which engage two mating female bowls on cooperating truck bolsters. As a consequence, the center plates must endure not only the weight of the car and loading distributed over their engaging surfaces under standing conditions, but also the shifting concentration and dynamic augment of these loads with associated wear encountered under rolling in-service conditions. In accordance with the prior art, a preferred construction has been a combination of a fabricated or cast steel center filler with or without draft lugs, a through bottom coverplate and a separate center plate bolted or welded to the bottom cover plate. This permits easy removal of the center plate when it has become worn or cracked and over the years has been found to provide a center plate life expectancy of about five to ten years.

With the advent of higher, longer and heavier cars for increased lading capacity, it has been found that such prior designs have been unable to withstand the greater load forces imposed thereby. Center plates under these conditions have been generally characterized by reduced life expectancies on the order of one to two years rendering maintenance and car down time costs unduly excessive if not prohibitive.

Improved results were achieved by eliminating the need for a separate center filler component and mounting the center plate to the underside of the center sill. By means of vertical shear horizontal tie plates in the sill pocket thereat, adequate structural resistance against shear and vertical forces was provided. At the same time, when repair of the center plate was required, it could readily be removed for replacement. With this type of center plate, the bottom-open pocket in which it is disposed is generally of a square configuration. Thus, the center plate can be applied in four positions, two of which are incorrect with respect to the bevels on the center plate. This part is placed into the open pocket usually by a workman who often is totally unskilled with regard to knowledge about freight car components. When the center plate is put in improperly and welded in place, it is a rather expensive job to remove the center plate and replace it.

Accordingly, it is among the objects of this invention to provide a center plate assembly having a rejection means permitting it to be installed in only the two proper positions within the bottom-open pocket of the underframe.

In accordance with the present invention, there is provided a center plate assembly for a railway car. The assembly comprises a center plate having a lower cap for mating with a truck bolster bowl and upstanding side walls which are disposed in a bottom-open pocket in a railway car underframe. The pocket is formed by a pair of shear plates and a portion of a U-shaped center sill therebetween. One or both of the shear plates and one or two of the side walls have means for polarizing the center plate in the pocket.

Figure 1:
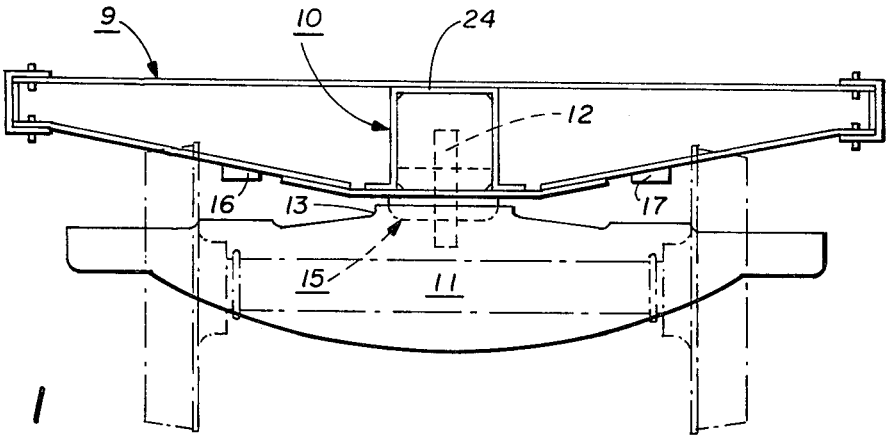
FIG. 1 is an elevation view of a car bolster construction assembled on a supporting truck bolster.

Reference for purposes of orientation is made to FIG. 1 in which a body bolster 9 having side bearing supports 16 and 17 extends transversally to a car body intersecting the body center sill 10 thereon. Bolster 9 contains center plate 15 and is normally connnected via and interfit with bowl 13 to a truck bolster 11. A vertical king pin 12 extending upward from bowl 13 through a bore 14 in center plate 15 provides a safety measure against separation in the event of any vertical displacement in service. Such a connection is conventional in the industry and will not be further described. Mentioned herein to "top", "bottom", "underside", "topside", "horizontal", "vertical", etc., will be with regard to the orientation shown and described in connection with FIG. 1.

Figure 2:
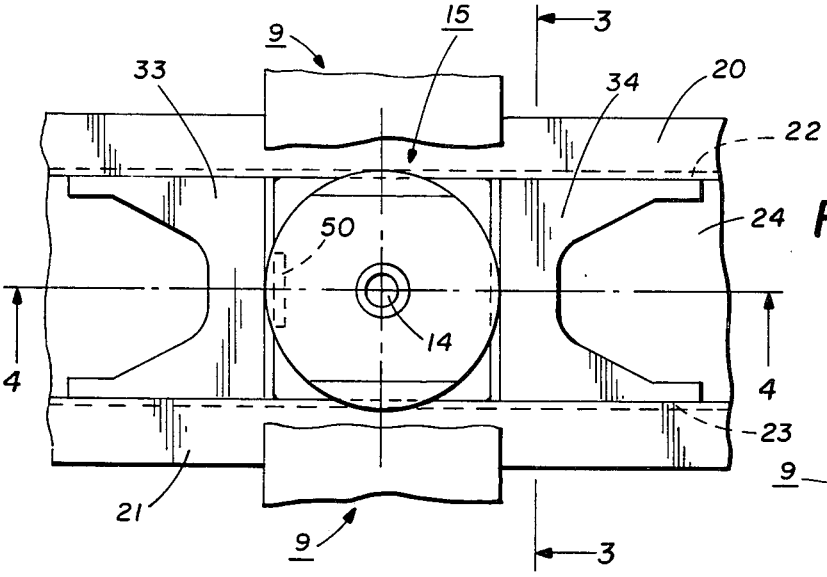
FIG. 2 is a partial underside plan view of the center plate mounted onto the center sill of the car body embodying the features of the present invention.
Figure 3:
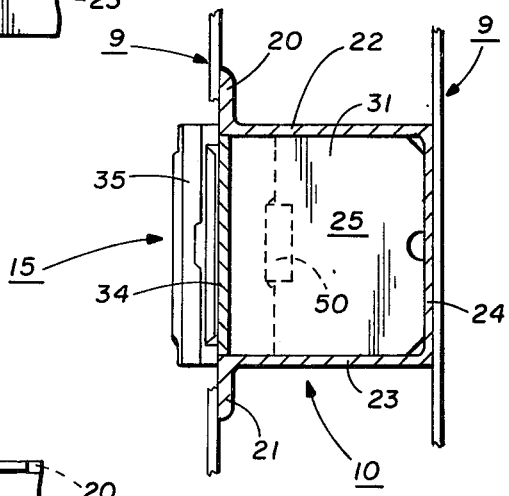
FIG. 3 is an elevation view, partly in cross section, taken along line 3—3 of FIG. 2.
Figure 4:
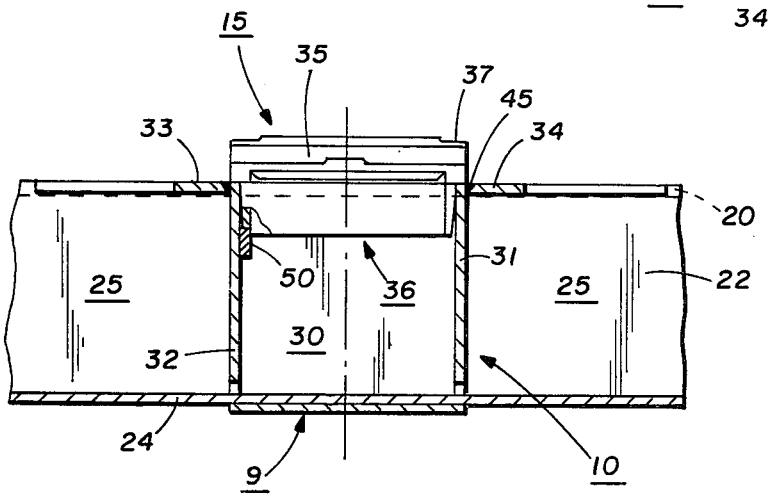
FIG. 4 is an elevation view, partly in cross section, taken along line 4—4 of FIG. 2.

Referring now to FIGS. 2–4, there is shown a first combination embodiment of a center plate assembly containing the polarizing means of the present invention. As can be seen, center sill 10 is conventionally comprised internally in cross section as an inverted U-shaped steel rolled section consisting of vertical side walls 22 and 23 joined by top wall 24 to define a centrally interior longitudinally extending hollow pocket 25 therein. At the underside of the section are a pair of parallel longitudinally extending flanges 20 and 21 laterally integral with side walls 22 and 23.

To receive center plate 15, there is defined about the geometric center of bolster 9, a central pocket 30 formed open and exposed at the bottom by parallel spaced apart vertically arranged shear plates 31 and 32 and the included portions of sill walls 22 and 23 therebetween. Each spacer plate is complementary to the internal sill cross section thereat and is completely welded about its periphery in a rigid fixed relation to the intersecting surfaces of sidewalls 22 and 23 and topwall 24. One of the shear plate surfaces could be formed from a pair of cast draft lugs as is disclosed and claimed in a co-pending application assigned to the present assignee. One of the shear plates contains a stop lug 50 in the form of a rectangular bar welded substantially contrally thereon. The other shear plate could have a similar stop lug. The center plate contains a notch 52 (see FIGS. 7 and 8) in the upper portion of an opposed pair of upstanding sidewalls. This enables the installer to install the center plate properly since the notch and bar or stop lug will mate and fit together. If the center plate is installed so that the other pair of walls are adjacent the lugs, the plate will be rejected.

Figure 5:
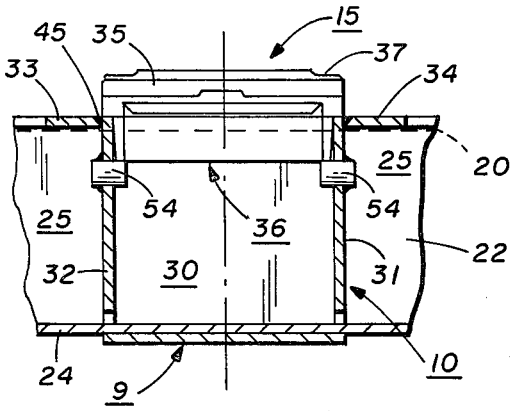
FIG. 5 is an elevation view, partly in cross section, similar to FIG. 4 but showing another embodiment of the present invention.
Figure 6:
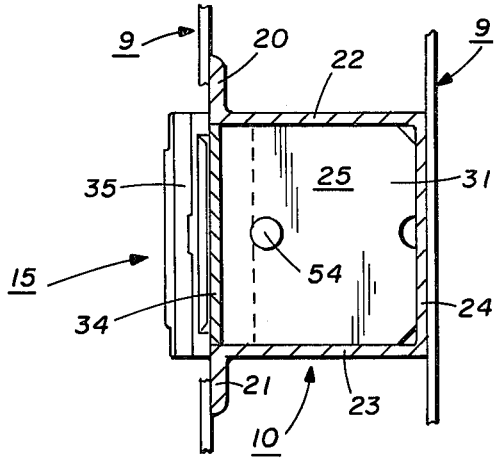
FIG. 6 is an elevation view, partly in cross section, taken along line 6—6 of FIG. 5.

FIGS. 5 and 6 show another embodiment of the invention utilizing a pair of stop lugs. Here the lugs 54 pass through the walls of the shear plates and are exposed on both sides. This would enable the car builder to install the shear plates without concern that the stop lugs are on the proper interior surfaces thereof. The construction could be made substantially foolproof by inserting said lugs at the same spaced distance at both the upper and lower ends of the shear plates, if desired.

Further securing the shear plates are horizontal tie plates 33 and 34, each extending laterally across pocket 25 adjacently outward of pocket 30. The tie plates are arranged with their undersurface between and substantially co-planer with the undersurface of side flages 20 and 21 and are secured by welding on three sides to the contiguous surfaces of the sill walls and shear plate thereat. By this means, a completely rigid joint is formed at the intersection of the tie plate to the lower end of the shear plate.

Figure 7:
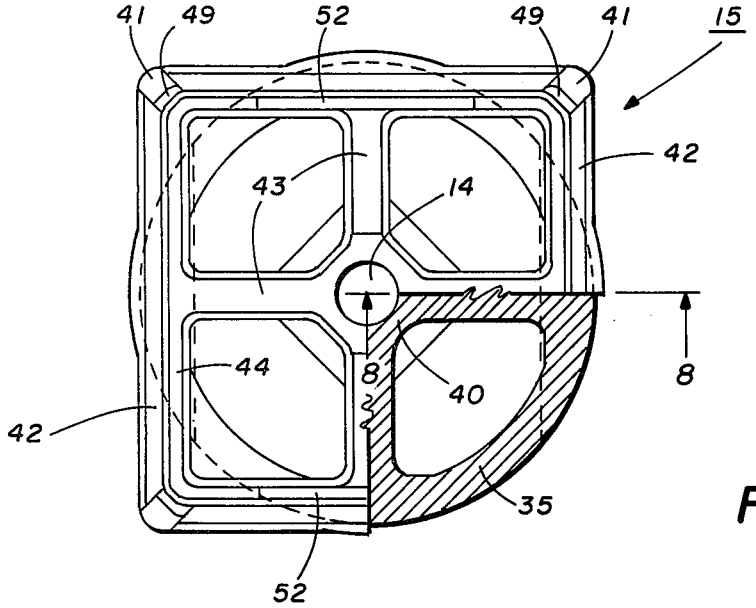
FIG. 7 is a topside plan view, partly in cross section, of the center plate.
Figure 8:
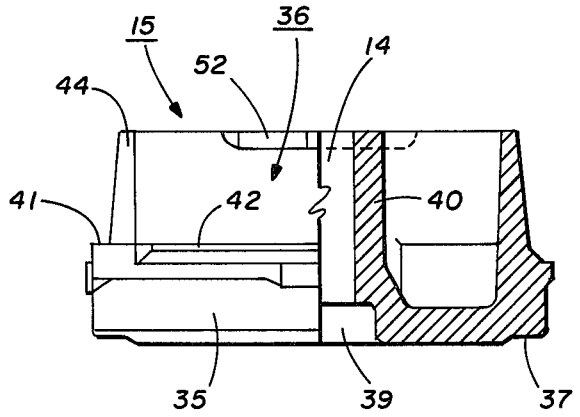
FIG. 8 is an elevation view in partial cross section taken along line 8—8 of FIG. 7.

Center plate 15 hereof generally comprising a bowl-like configuration is most clearly shown in FIGS. 7 and 8. The center plate comprises a lower cap section 35 of generally circular extent and usually of a diameter greater than the internal clearance dimensions of pocket 30. The cap may contain wear indicating recesses on the circumferential side surfaces if desired. This feature is more fully described in U.S. Pat. No. 3,834,774, assigned to the present assignee. Communicating integrally with the cap is an upper webbed section 36 of dimension able to be received within pocket 30. Centrally located in cap 35 is a recess 39 communicating with bore 14 formed in an upstanding hub 40 and through which a truck bolster king or center pin 12 is received as described above in connection with FIG. 1. Bevel flats 37, at the under opposite corner edges of cap 35, provide line instead of point contact against truck bowl 13 during dynamic in-service oscillation therebetween.

The topmost portion of cap section 35 is represented by four corner positioning pads 41 each having a finished horizontally extending surface and connecting with intermediate beveled welding surfaces 42. Upper section 36 includes a thin encircling web 44 which extends integrally upward from the plane of pads 41 and slopes approximately 2° to 3° inward to permit easy insertion within the pocket 30. Providing additional reinforcement to central hub 40 are a plurality of web flanges 43 extending radially to merge with each of the enclosing side walls of web 44. Center plate 15 in its entirety is preformed of cast steel or the like without the necessity of hot pressing and by virtue of its size can be easily handled for purposes of finish machining and/or heat treatment, if desired.

Assembly of the center plate into pocket 30 is by first placing positioning pads 41 against the exposed surface edges of the sill and shear plates and then butt welding around at 45 between surface 42 and adjacent sill or shear plate edges thereat. When so secured, the sidewalls act in forming a secured and completely boxed structure with center plate 15 closing off the pocket bottom. At the same time, shear plates 31 and 32 welded on three sides to the sill walls thereat become welded on their fouth side to center plate 15. In this relation, the upright shear plates are ideally secured for resistance against parallelogramming of the sill during rock and roll of the moving car. By being so secured, the shear pleates act as a virtually perfect bolster shear transfer device while also serving as vertical load support. Should the center plate require maintenance by virtue of either failure or wear, it can similarly be removed without disturbing the balance of the structure.

Since many changes could be made in the above construction, and many apparently widely different embodiments of this invention could be made without departing from the scope thereof, it is intended that all matter contained in the drawings and specification shall be interpreted as illustrative and not in a limiting sense.

The embodiments of the invention in which an exclusive property or privilege is claimed are defined as follows:

1. In a body bolster center plate assembly for a railway car comprising in combination a center sill having walls contiguously arranged generally U-shaped in cross section and forming a centrally open interior; body bolster of longitudinal extent having a centrally defined laterally extending opening receiving said center sill intersecting therewith; shear plates longitudinally spaced apart secured within said sill interior to the walls thereof, at least one of said plates being located on each side of the center of intersection between said bolster and sill; said shear plates and portion of said sidewalls included therebetween defining a generally rectangular bottom-open pocket in which to receive a center plate; a center plate having a first portion of exterior dimension greater than said pocket for extending outward of the underside thereof and connecting with a second portion of reduced exterior dimension received within said pocket; and means securing the center plate to the underedge of said pocket walls forming a fixed rigid structure thereat, said center plate being detachable upon removal of said means; the improvement comprising said centerplate and said shear plate containing means for polarizing said center plate within the bottom-open pocket. Wherein the polarizing means on said shear plates is at least one stop lug disposed on the interior surface thereof for permitting the center plate to be installed in only two proper positions within the bottom-open pocket.

2. The assembly of claim 1 in which the polarizing means on said center plate is at least one complementary notch on said second portion of reduced exterior dimension thereof.

3. An assembly according to claim 1 in which said stop lug is also disposed exterior of the shear plate.

4. An assembly according to claim 1 in which said stop lugs are bars which are welded to said shear plates.

5. The assembly according to claim 3 in which said stop lug is a rod which passes through and is secured within an aperture in said shear plate.

6. An assembly according to claim 1 in which said center sill also includes laterally outward flanges integrally extending longitudinally along the underside thereof.

7. An assembly to claim 1 including horizontal tie plates adjacently exterior of said pocket secured to the sill sidewall and shear plate thereat.

8. An assembly according to claim 1 in which said pocket is generally square and said center plate is securely welded to the underedges of said pocket walls.

9. An assembly according to claim 1 in which said center plate includes a centrally hollow upstanding hub to receive a king pin from a truck bolster on which it is to be supported.

* * * * *